US006874254B1

(12) United States Patent
Silvera et al.

(10) Patent No.: US 6,874,254 B1
(45) Date of Patent: Apr. 5, 2005

(54) THONG-TYPE SHOE HAVING A HEEL AND A LAYERED SOLE

(75) Inventors: Albert J. Silvera, Manhattan Beach, CA (US); Boris Finkleberg, Huntington Beach, CA (US); Royce Lee, Taipei (TW)

(73) Assignee: Seychelles Imports, LLC, Gardena, CA (US)

( * ) Notice: Subject to any disclaimer, the term of this patent is extended or adjusted under 35 U.S.C. 154(b) by 0 days.

(21) Appl. No.: 10/698,797

(22) Filed: Oct. 30, 2003

(51) Int. Cl.[7] ..... A43B 13/28

(52) U.S. Cl. ..... 36/11.5; 36/12; 36/24.5; 36/76 R

(58) Field of Search ..... 36/11.5, 24.5, 36/76 R, 76 C, 107, 108, 12

(56) References Cited

U.S. PATENT DOCUMENTS 1,647,525 A * 11/1927 Kelly et al. ..... 12/142 G
2,057,703 A * 10/1936 Blake ..... 36/24.5
2,186,470 A * 1/1940 Bastable ..... 36/34 R
2,202,941 A * 6/1940 Bastable ..... 36/34 R
2,374,954 A * 5/1945 Erasmo ..... 36/34 R
2,852,865 A * 9/1958 Spalding ..... 36/37
3,016,630 A * 1/1962 Twiggs, Jr. ..... 36/101
3,336,683 A * 8/1967 Schellkopf ..... 36/11.5
4,219,946 A * 9/1980 Baum ..... 36/42
5,416,989 A * 5/1995 Preston ..... 36/108

OTHER PUBLICATIONS

Three photographs showing three different views of a SIGERSON MORRISON shoe, also indicating the name VIBRAM, sold prior to the present invention.

* cited by examiner

*Primary Examiner*—Marie Patterson
(74) *Attorney, Agent, or Firm*—Mitchell Silberberg & Knupp LLP

(57) ABSTRACT

Provided is thong-type shoe that has a heel and a layered sole, with a shape-retaining member sandwiched between the layers. In one example, the shoe according to the present invention has a top layer, a bottom layer and a shape-retaining member sandwiched between the two, with a heel mounted to the shape-retaining member through the bottom layer. A provided upper has plural elongated insert elements, each having a stopper on its bottom end. Each of the plural elongated insert elements extends through a hole in the top layer and a hole in the bottom layer such that the stopper engages the hole in the bottom layer.

16 Claims, 1 Drawing Sheet

THONG-TYPE SHOE HAVING A HEEL AND A LAYERED SOLE

BACKGROUND OF THE INVENTION

1. Field of the Invention

The present invention pertains to footwear and is directed, e.g., to a shoe having a heel and a thong-type construction that utilizes a layered sole.

2. Description of the Related Art

Thong-type sandals have been available for a long time. Basically, such sandals typically are manufactured by: (i) cutting several layers from one or more different types of sheet material, each layer having plural matching holes; (ii) bonding such layers together; and then (iii) inserting the ends of an thong upper (usually made of plastic) through such holes in order to lock the upper into place. Because the sole of such a sandal is formed by bonding pieces of sheet material together, the sole usually is primarily flat.

Recently, at least one shoe has been provided that has an upper which resembles the upper for such thong-type sandals, but that also has a heel. In this shoe, the main portion of the sole is formed from one type of material and the bottom of this main portion is inlaid with a harder unitary piece that includes the heel. This harder unitary piece, as well as providing the heel, also provides additional support for the shoe.

However, such a shoe has certain inherent disadvantages. For example, the harder unitary piece typically must be injection molded, necessitating the creation of the appropriate molds. In addition, because the main portion of the sole both provides the surface for accommodating the wearer's foot and also provides the overall shape of the sole, it often will be difficult to provide an acceptable level of comfort.

SUMMARY OF THE INVENTION

The present invention addresses this problem by providing a thong-type shoe that has a heel and a layered sole, typically with a shape-retaining member sandwiched between the layers.

Thus, in one aspect the invention is directed to a shoe having a top layer, a bottom layer and a shape-retaining member sandwiched between the two, with a heel mounted to the shape-retaining member through the bottom layer. The shape-retaining member may, for example, be comprised of a tuck board and a shank. A provided upper has plural elongated insert elements, each having a stopper on its bottom end. Each of the plural elongated insert elements extends through a hole in the top layer and a hole in the bottom layer such that the stopper engages the hole in the bottom layer.

By virtue of the foregoing arrangement, a number of different design characteristics that are not easily attainable with conventional configurations are facilitated. For example, a shoe according to the present invention can have a high heel and a sock that is softer than other portions of the shoe. In addition, using the foregoing configuration, such shoes typically can be made without the need for investing in special-purpose molds for forming the outsole.

In more particularized aspects of the invention, the top layer includes a filled-in cutout that is disposed directly above the heel. The provision of such a cutout (or hole) can allow for easier attachment of the heel during the manufacturing process.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
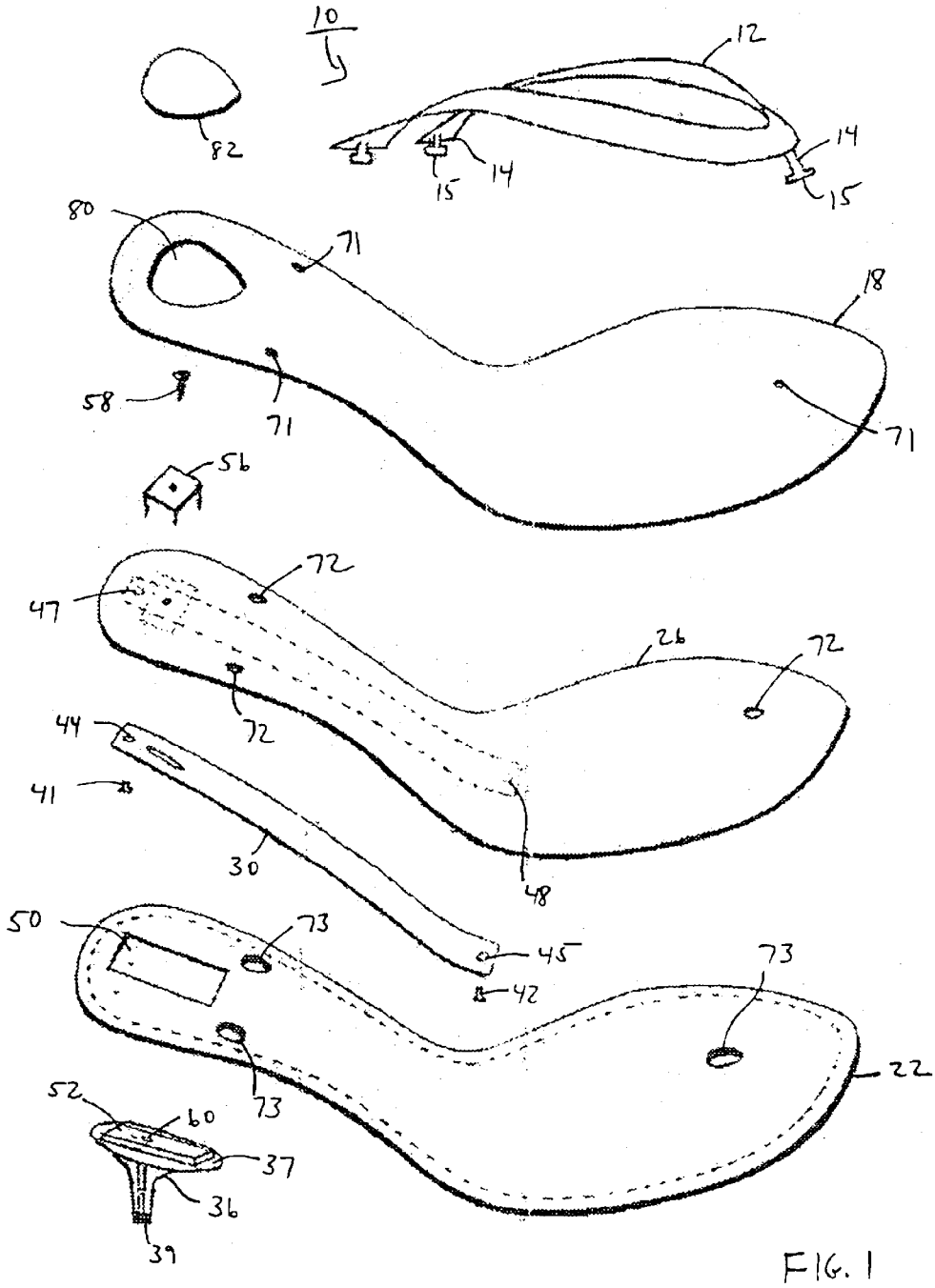
FIG. 1 is an exploded view of a shoe according to representative embodiment of the present invention.

FIG. 1 illustrates an exploded view of a shoe 10 according to a representative embodiment of the present invention. As shown, shoe 10 has a thong-type upper 12 which preferably is comprised of polyvinylchloride (PVC), but may be made from any other type of material. Included in upper 12 are three elongated insert elements 14, each having a stopper 15 at its distal end. Of course, depending upon the design of shoe 10, any other number of elongated insert elements 14 may instead be used. The elongated insert elements 14 preferably have a circular cross-section, and each stopper 15 preferably is configured as a disk and is arranged perpendicular to its corresponding elongated insert element 14. Any conventional technique may be utilized for manufacturing upper 12, such as injection molding.

Although upper 12 is illustrated in FIG. 1 as being a unitary piece having a particular shape, a variety of other shapes and/or configurations also are possible. For example, two elongated insert elements 14 may be used to create a toe ring; the upper may include a cross band with two elongated insert elements; and/or the upper may be comprised of flaps that attached to each other using Velcro. In the preferred embodiments of the invention, shoe 10 is designed so as to not require elongated insert elements 14 and corresponding through-holes near the edges of the sole (which would create a risk of having the cemented sole pull apart).

An upper layer (or sock) 18 provides the surface layer upon which the wearer's foot rests. Preferably, upper layer 18 is formed from thermoplastic rubber (TPR), although it may instead the formed from PVC or any other material. In any event, the hardness of upper layer 18 preferably is in the approximate range of 40–50 degrees on the Rockwell hardness scale.

Lower layer 22 provides the outsole for shoe 10 and preferably is matched in size and shape to upper layer 12. Lower layer 22 also preferably is formed of TPR, but again may be formed from any other material. In the preferred embodiment of the invention, lower layer 22 is significantly harder than upper layer 18. As a result, it preferably has a hardness of 85 degrees or more.

Each of upper layer 18 and lower layer 22 may be formed in a similar manner. Specifically, a sheet of the desired material (e.g., TPR) may be manufactured, e.g., by pouring such material into a flat mold. Then, the resulting sheet may be stamped to create the desired shape for layer 18 or layer 22, as the case may be. The same stamping operation may be used to create any desired holes through the subject layer, e.g., as described below.

A tuck board 26 is sandwiched between upper layer 18 and lower layer 22. The function of th tuck board 26 is to help maintain the shape of shoe 10. Accordingly, it may be formed from composite materials, fiberglass or any of a variety of other strong, stiff materials. As shown, tuck board 26 approximately matches the shape of upper layer 18 and lower layer 22, but preferably is slightly smaller than either such layer.

In the present embodiment of the invention, a high-heeled shoe 10 is being manufactured. As a result, tuck board 26 will have a 3-dimensional shape. This may be accomplished by stamping tuck board 26 into the desired flat shape from a sheet of any of the materials described above. During this stamping operation, any desired holes through the board 26 also may be punched. Then, tuck board 26 is formed into the appropriate 3-dimensional shape by utilizing a preformed mold. The edges of the board 26 preferably are buffed in order to eliminate any rough and/or frayed edges. This buffing step in many cases can allow tuck board 26 to fit better and can enhance the integrity of the cementing process; it may be performed either prior to or after the 3-dimensional forming step.

Attached to tuck board 26 is a shank 30 that typically is formed from steel or a similar strong metal, thereby providing additional strength and helping to transfer or distribute weight to the heel and forepart of shoe 10. Shank 30 may be formed by simply stamping it from a sheet of metal and then using a preformed mold to form shank 30 into the desired 3-dimensional shape. Alternatively, shank 30 may be formed from PVC, acrylonitrile butadiene styrene (ABS), a hard TPR or any other stiff, bend-resistant material. In the present embodiment, shank 30 is formed as a long, flat rectangular piece. However, other shapes may instead be used to achieve different results.

Together, tuck board 26 and shank 30 function as a shape-retaining member. Of course, if the board 26 is sufficiently strong it may be possible to omit shank 30. However, it generally will be desirable to have a combination of the tuck board 26 and shank 30 in order to provide certain portions of the shoe with greater flexibility and other portions of the shoe with greater strength. As will be apparent to those skilled in the art, a variety of different configurations (using a tuck board, one or more shanks and/or other components) may be employed, depending upon the design goals to be achieved (i.e., where the designer wants increased strength, increased flexibility, increased compressibility, etc.), as well as based upon the type of shoe being constructed.

In the preferred embodiment of the invention, a separate heel 36 is provided and is attached to the remainder of shoe 10 in the manner described below. Preferably, for reasons of cost and strength, heel 36 is formed from PVC or a similar plastic, although it may instead the formed from any of a variety of other materials. The heel 36 preferably is at least one inch high (measured from the surface 37 that normally comes into contact with the bottom surface of outsole 22 to the bottom 39 of heel 36, and more preferably is at least two inches or at least three inches high.

The construction of shoe 10 will now be discussed with reference to FIG. 1. Initially, shank 30 is attached to tuck board 26. This may be accomplished using a combination of glue and rivets. As shown, rivets 41 and 42 may be inserted through-holes 44 and 45, one on each end of shank 30, and corresponding holes 47 and 48 through tuck board 26.

Next, the tuck board 26 (with shank 30 attached) is cemented to outsole 22. Thereafter, heel 36 is then attached in the following manner.

As shown in FIG. 1, outsole 22 is provided with a rectangular hole 50, and the top portion of heel 36 has a matching rectangular piece 52. Accordingly, piece 52 (preferably coated with cement for adhering to the bottom surface of tuck board 26) is inserted into hole 50. Then, a four-point staple 56 is driven through tuck board 26 and into the top surface rectangular piece 52 on heel 36, thereby permanently attaching heel 36 to shoe 10. A screw 58 may then be driven through a hole 59 in staple 56 and through a hole 60 in the rectangular piece 52 of heel 36, in order to further strengthen the attachment. As indicated, in the present embodiment of the invention, a four-point staple 56 and screw 58 are used as the primary means for attaching heel 36 to the shape-retaining member comprised the tuck board 26 and shank 30. However, any of a variety of other types of known fasteners may instead (or in addition) be used.

The top layer 18 is then cemented to the tuck board 26 and the elongated insert elements 14 are inserted through matching aligned holes 71–73 in the sock 18, tuck board 26 and outsole 22, respectively. This latter operation is performed using a special tool that resembles elongated players, squeezing the stopper 15 tightly, pulling it through the corresponding holes, and then pulling back up on upper 12 in order to seat the stopper 15 in the hole 73 in outsole 22.

Lastly, the edges of the layered sole are buffed in order to create a smooth surface. It is noted that, by virtue of the foregoing arrangement, no special shaping of the sock 18 or outsole 22 is required. Rather, both such components can be simply stamped from a sheet of material; they then acquire their 3-dimensional shape when bonded (typically using a combination of heat and pressure) to the shape-retaining member that, in the current embodiment, is comprised of tuck board 26 and shank 30.

Variations on the foregoing manufacturing method also are contemplated. For instance, the rivets 41 and 42 that are used to attach shank 30 to tuck board 26 may be enlarged and provided with an inner through-hole. Then, if the shank 30 and the rivets 41 and 42 are appropriately positioned, the elongated insert elements 14 may be inserted through the rivets' through-holes, thereby eliminating the requirement of stamping or drilling separate holes 72 through tuck board 26.

In another embodiment of the invention, upper layer 18 is provided with a hole to 80 that provides access to the tuck board 26 at the location where the heel 36 attaches to tuck board 26. Accordingly, the upper layer 18 and lower layer 22 may be bonded, together with tuck board 26, in a single step. Then, the staple 56 (or any other desired fasteners) may be inserted through hole 80. Finally, an insert piece 82 (e.g., with cement on its bottom surface) is placed into hole 80 to complete the manufacturing process. Alternatively, insert piece 82 may be provided by injecting filler material (e.g., silicone) into hole 80 and allowing such filler material to harden.

Not only does the foregoing variation eliminate one step in the manufacturing process, but the use of a separate insert piece 82 provides the designer with additional flexibility. For example, insert piece 82 may be softer than the sock 18, thereby providing additional comfort at the heel of shoe 10. Alternatively (or in addition), insert piece 82 may be of a different type of material, of a different color or have a different aesthetic design impressed and/or imprinted thereon, as compared to sock 18.

It should be noted that, although insert piece 82 is illustrated in FIG. 1 as matching hole 80 in size and shape, other configurations also are possible. For example, piece 82 may generally have a mushroom shape, with the bottom portion fitting into hole 80 and the top portion covering most (or at least a greater portion) of the heel area of shoe 10.

Additional Considerations

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality may be ascribed to a particular module or component. However, unless any particular functionality is described above as being critical to the referenced module or component, functionality may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe comprising:

(a) a top layer;

(b) a bottom layer;

(c) a shape-retaining member sandwiched between the top layer and the bottom layer; and (d) a heel mounted to the shape-retaining member through the bottom layer;

(e) an upper having plural elongated insert elements, each having a stopper on its bottom end, each of the plural elongated insert elements extending through a hole in the top layer and a hole in the bottom layer such that the stopper engages the hole in the bottom layer.

2. A shoe according to claim 1, wherein the top layer includes a filled-in cutout that is disposed directly above the heel.

3. A shoe according to claim 1, wherein both the top layer and the bottom layer are comprised of thermoplastic rubber (TPR).

4. A shoe according to claim 1, wherein the shape-retaining member is comprised of a metal.

5. A shoe according to claim 1, wherein the shape-retaining member comprises a tuck board that at least approximately matches a shape of the top layer and the bottom layer and a smaller shank that is stronger and stiffer than the tuck board.

6. A shoe according to claim 5, wherein the shank is disposed along a portion of the shoe that is elevated by the heel.

7. A shoe according to claim 5, wherein the shank is attached to the tuck board using cement and rivets.

8. A shoe according to claim 1, wherein each of the top layer and the bottom layer have been formed by stamping a sheet of material.

9. A shoe according to claim 1, wherein at least a portion of the shape-retaining member has been stamped out of metal.

10. A shoe according to claim 1, wherein the heel is mounted to the shape-retaining member by driving fastener through the shape-retaining member and into a top portion of the heel.

11. A shoe according to claim 1, wherein at least one of the plural elongated insert elements also extends through a hole in the shape-retaining member.

12. A shoe according to claim 1, wherein the top layer, bottom layer and shape-retaining member are attached using segment.

13. A shoe according to claim 1, wherein the heel is at least two inches in length.

14. A shoe according to claim 1, wherein the heel is at least three inches in length.

15. A shoe according to claim 1, wherein the top layer is softer than the bottom layer.

16. A shoe according to claim 1, wherein both the top layer and the bottom layer are comprised of a sheet material.

* * * * *